US010396503B2

(12) United States Patent
Yuan et al.

(10) Patent No.: US 10,396,503 B2
(45) Date of Patent: Aug. 27, 2019

(54) DIFFERENTIAL CONNECTOR AND HOUSING COMPONENT THEREOF

(71) Applicant: AVIC JONHON OPTRONIC TECHNOLOGY CO., LTD, Henan (CN)

(72) Inventors: Junfeng Yuan, Henan (CN); Lufei Ma, Henan (CN); Guoqi Zhou, Henan (CN)

(73) Assignee: AVIC JONHON OPTRONIC TECHNOLOGY CO., LTD, Henan (CN)

( * ) Notice: Subject to any disclaimer, the term of this patent is extended or adjusted under 35 U.S.C. 154(b) by 0 days.

(21) Appl. No.: 16/097,839

(22) PCT Filed: Mar. 21, 2017

(86) PCT No.: PCT/CN2017/077469

§ 371 (c)(1),
(2) Date: Oct. 31, 2018

(87) PCT Pub. No.: WO2018/018898

PCT Pub. Date: Feb. 1, 2018

(65) Prior Publication Data

US 2019/0140400 A1 May 9, 2019

(30) Foreign Application Priority Data

Jul. 29, 2016 (CN) ..... 2016 1 0610603
Nov. 30, 2016 (CN) ..... 2016 1 1083103

(51) Int. Cl.
*H01R 24/00* (2011.01)
*H01R 13/659* (2011.01)
(Continued)

(52) U.S. Cl.
CPC ..... *H01R 13/659* (2013.01); *H01R 13/6583* (2013.01); *H01R 13/6598* (2013.01)

(58) Field of Classification Search
CPC ..... H01R 13/659; H01R 13/6598; H01R 13/6583; H01R 12/58; H01R 13/6585; H01R 13/6633; H01R 13/6625
(Continued)

(56) References Cited

U.S. PATENT DOCUMENTS 6,325,672 B1 * 12/2001 Belopolsky ..... H01R 13/6625 439/607.34
2014/0170904 A1 * 6/2014 Tang ..... H01R 13/6633 439/620.23
(Continued)

FOREIGN PATENT DOCUMENTS

CA 2399960 8/2001
CN 1401147 3/2003
(Continued)

OTHER PUBLICATIONS

"International Search Report (Form PCT/ISA/210)", dated Jun. 22, 2017, with English translation thereof, pp. 1-4.
(Continued)

*Primary Examiner* — Jean F Duverne
(74) *Attorney, Agent, or Firm* — JCIPRNET

(57) ABSTRACT

The present invention relates to the field of electrical connectors, and in particular to a differential connector and a housing component thereof. The differential connector comprises a housing component and two or more differential modules. Each differential module comprises an insulator, differential pairs and ground contacts. The housing component comprises a housing. A plugging hole corresponding to a plug-in end of the differential pair is provided on the housing. An end shield corresponding to the plug-in end of the differential pair is provided on the housing. The end shield is provided with a shield groove extending along a plugging direction of the plug-in end of the differential pair. Openings of shield grooves face toward the same direction.
(Continued)

The plug-in end of the differential pair is provided in the shield groove so as to be isolated from a plug-in end of an adjacent differential pair of the same differential module.

20 Claims, 7 Drawing Sheets

(51) Int. Cl.
*H01R 13/6598* (2011.01)
*H01R 13/6583* (2011.01)

(58) Field of Classification Search
USPC ..... 439/660
See application file for complete search history.

(56) References Cited

U.S. PATENT DOCUMENTS

| | | | | |
|---|---|---|---|---|
| 2014/0194005 | A1* | 7/2014 | Little | H01R 13/6585 439/607.28 |
| 2014/0349518 | A1 | 11/2014 | Chang et al. | |
| 2018/0090887 | A1* | 3/2018 | Little | H01R 12/58 |

FOREIGN PATENT DOCUMENTS

| | | |
|---|---|---|
| CN | 1421059 | 5/2003 |
| CN | 101312275 | 11/2008 |
| CN | 201430243 | 3/2010 |
| CN | 101884140 | 11/2010 |
| CN | 101335406 | 6/2011 |
| CN | 103151650 | 6/2013 |
| CN | 103311746 | 9/2013 |
| CN | 104300313 | 1/2015 |
| CN | 105470736 | 4/2016 |
| CN | 106207637 | 12/2016 |
| DE | 69718948 | 12/2003 |
| KR | 20060083035 | 7/2006 |
| TW | 201445828 | 12/2014 |
| WO | 0157964 | 8/2001 |
| WO | 2014066591 | 5/2014 |

OTHER PUBLICATIONS

"Search Report of Europe Counterpart Application", dated Mar. 29, 2019, p. 1-p. 15.

* cited by examiner

DIFFERENTIAL CONNECTOR AND HOUSING COMPONENT THEREOF

CROSS-REFERENCE TO RELATED APPLICATION

This application is a 371 application of the international PCT application serial no. PCT/CN2017/077469, filed on Mar. 21, 2017, which claims the priority benefit of China application no. 201610610603.2, filed on Jul. 29, 2016, and China application no. 201611083103.4, filed on Nov. 30, 2016. The entirety of each of the abovementioned patent applications is hereby incorporated by reference herein and made a part of this specification.

BACKGROUND OF THE INVENTION

1. Field of the Invention

The present invention relates to the field of electrical connectors, and in particular to a differential connector and a housing component thereof.

2. Description of Related Art

In a conventional differential connector, an empty groove for mounting a shield sheet is provided inside a housing component of the connector. For example, a fully shielded differential connector disclosed in China Patent Publication No. CN104300313A and published on Jan. 21, 2015 includes a housing component and two or more differential modules. Each differential module includes an insulator, differential pairs and ground pins (i.e. ground contacts). Plugging holes corresponding to the differential pairs and the ground pins are provided on the housing component. A trace shield is provided on at least one side of the insulator, and the trace shield is provided between any two differential modules. An end shield is provided on at least one side of a plugging section of the differential pair, and the end shield is provided between the corresponding differential pairs of any two differential modules and being electrically connected to the corresponding trace shield. During use, the end shield is disposed between the plugging sections of the differential pairs of two adjacent differential modules, so as to prevent electromagnetic interference between the plugging sections of the differential pairs of the two differential modules, thereby solving the problem that the existing differential connector destroys the signal integrity of a transmission line. However, during the use of this differential connector, the differential pairs of the adjacent differential modules still undergo an electromagnetic leakage in multiple areas and are affected, thereby finally affecting the quality of signal transmission.

SUMMARY OF THE INVENTION

The present invention is directed to provide a differential connector, intended to solve the problem of electromagnetic interference existing between differential pairs of adjacent differential modules of a current differential connector. In addition, the present invention is also directed to provide a differential connector housing component used by the foregoing differential connector.

To this end, a first technical solution for a differential connector of the present invention is as follows. The differential connector includes a housing component and two or more differential modules. Each differential module includes an insulator, differential pairs and ground contacts. The housing component includes a housing. A plugging hole corresponding to a plug-in end of the differential pair is provided on the housing. An end shield corresponding to the plug-in end of the differential pair is provided on the housing. The end shield is provided with a shield groove extending along a plugging direction of the plug-in end of the differential pair. Opening of each shield groove faces toward the same direction. The plug-in end of the differential pair is provided in the shield groove so as to be isolated from a plug-in end of an adjacent differential pair of the same differential module.

A second technical solution for a differential connector of the present invention is as follows. The differential connector includes a housing component and at least two differential modules. Each differential module include an insulator, differential pairs and ground contacts. The housing component includes a housing. A plugging hole corresponding to a plug-in end of the differential pair is provided on the housing. An end shield corresponding to the plug-in end of the differential pair is provided on the housing. The end shield is provided with a shield groove extending along a plugging direction of the plug-in end of the differential pair. Openings of shield grooves of the end shields corresponding to the differential pairs of the same differential module face toward the same direction. The plug-in end of the differential pair is provided in the shield groove so as to be isolated from a plug-in end of an adjacent differential pair of the same differential module. The end shields corresponding to the differential pairs of the same differential module constitute an end shield group. When there are two end shield groups, openings of shield grooves of the two end shield groups face toward opposite directions. When there are more than two end shield groups, openings of shield grooves of only one pair of end shield groups in all pairs of adjacent end shield groups face toward opposite directions, and openings of shield grooves of the remaining pairs of adjacent end shield groups face toward the same direction.

A third technical solution for a differential connector of the present invention is as follows. In the differential connector according to the first or second technical solution of a differential connector of the present invention, the end shield includes an insulator layer and a shield layer provided on the insulator layer. The shield layer is a conductive shield layer. A trace shield is provided on at least one side of the insulator, the trace shield being provided between any two of the differential modules. The shield layer is electrically connected to the ground contact or the trace shield.

A fourth technical solution for a differential connector of the present invention is as follows. In the differential connector according to the third technical solution of a differential connector of the present invention, the shield layer is a metal plate. Connection ribs are provided between metal plates of adjacent end shields. The shield layer is electrically connected to the ground contact or the trace shield through the connection rib.

A fifth technical solution for a differential connector of the present invention is as follows. In the differential connector according to the third or fourth technical solution of a differential connector of the present invention, an end shield mounting hole is provided on the housing. A shield mounting structure is provided in the end shield mounting hole. A hole wall of the end shield mounting hole includes a first mounting hole wall section provided at a notch of the shield groove. The plugging hole is formed by the end shield and the first mounting hole wall section. The insulator layer is provided between the plugging hole and the shield layer.

A sixth technical solution for a differential connector of the present invention is as follows. In the differential connector according to any one of the first to fourth technical solutions of a differential connector of the present invention, an integrated module configured for integrating the end shields is provided on a housing. A shield mounting structure adapted to the end shield is provided on the integrated module. The integrated module is of a sleeve structure. The shield mounting structure is provided in the integrated module. Corresponding partial shield mounting structures are provided on adjacent side walls of the adjacent integrated modules. The corresponding partial shield mounting structures constitute the shield mounting structure.

A seventh technical solution for a differential connector of the present invention is as follows. In the differential connector according to the sixth technical solution of a differential connector of the present invention, an insulated partition plate is provided between two plugging holes corresponding to the differential pairs. The shield mounting structure includes an L-shaped insulated plate. An inverted L-shaped insulated plate in buckled connection with the L-shaped insulated plate is provided on the insulator layer. The insulated partition plate consists of the L-shaped insulated plate and the inverted L-shaped insulated plate.

To this end, a first technical solution for a differential connector housing component of the present invention is as follows. The differential connector housing component includes a housing. A plugging hole configured for corresponding to a plug-in end of a differential pair is provided on the housing. An end shield corresponding to the plug-in end of the differential pair is provided on the housing. The end shield is provided with a shield groove extending along a plugging direction of the plug-in end of the differential pair and containing the plug-in ends of the differential pairs such that the plug-in end of the differential pair is isolated from a plug-in end of an adjacent differential pair of the same differential module. Opening of each shield groove faces toward the same direction.

A second technical solution for a differential connector housing component of the present invention is as follows. The differential connector housing component includes a housing. A plugging hole corresponding to a plug-in end of the differential pair is provided on the housing. An end shield corresponding to the plug-in end of the differential pair is provided on the housing. The end shield is provided with a shield groove extending along a plugging direction of the plug-in end of the differential pair and containing the plug-in end of the differential pair to be isolated from a plug-in end of an adjacent differential pair of the same differential module. Openings of shield grooves of the end shields corresponding to the differential pairs of the same differential module face toward the same direction. The end shields corresponding to the differential pairs of the same differential module constitute an end shield group. When there are two end shield groups, openings of shield grooves of the two end shield groups face toward opposite directions. When there are more than two end shield groups, openings of shield grooves of only one pair of end shield groups in all pairs of adjacent end shield groups face toward opposite directions, and openings of shield grooves of the remaining pairs of adjacent end shield groups face toward the same direction.

A third technical solution for a differential connector housing component of the present invention is as follows. In the differential connector housing component according to the first or second technical solution of a differential connector housing component of the present invention, the end shield includes an insulator layer and a shield layer provided on the insulator layer. The shield layer is a conductive shield layer. A trace shield is provided on at least one side of the insulator, the trace shield being provided between any two of the differential modules. The shield layer is electrically connected to the ground contact or the trace shield.

A fourth technical solution for a differential connector housing component of the present invention is as follows. In the differential connector housing component according to the third technical solution of a differential connector housing component of the present invention, the shield layer is a metal plate. Connection ribs are provided between metal plates of adjacent end shields. The shield layer is electrically connected to the ground contact or the trace shield through the connection rib.

A fifth technical solution for a differential connector housing component of the present invention is as follows. In the differential connector housing component according to the third or fourth technical solution of a differential connector housing component of the present invention, an end shield mounting hole is provided on the housing. A shield mounting structure is provided in the end shield mounting hole. A hole wall of the end shield mounting hole includes a first mounting hole wall section provided at a notch of the shield groove. The plugging hole is formed by the end shield and the first mounting hole wall section. The insulator layer is provided between the plugging hole and the shield layer.

A sixth technical solution for a differential connector housing component of the present invention is as follows. In the differential connector housing component according to any one of the first to fourth technical solutions of a differential connector housing component of the present invention, an integrated module configured for integrating end shields is provided on a housing. A shield mounting structure adapted to the end shield is provided on the integrated module. The integrated module is of a sleeve structure. The shield mounting structure is provided in the integrated module. Corresponding partial shield mounting structures are provided on adjacent side walls of the adjacent integrated modules. The corresponding partial shield mounting structures constitute the shield mounting structure.

A seventh technical solution for a differential connector housing component of the present invention is as follows. In the differential connector housing component according to the sixth technical solution of a differential connector housing component of the present invention, an insulated partition plate is provided between two plugging holes corresponding to the differential pairs. The shield mounting structure includes an L-shaped insulated plate. An inverted L-shaped insulated plate in buckled connection with the L-shaped insulated plate is provided on the insulator layer. The insulated partition plate consists of the L-shaped insulated plate and the inverted L-shaped insulated plate.

The present invention has the beneficial effects that a shield groove is provided on an end shield corresponding to a differential pair of a differential module of the differential connector of the present invention, and opening of each shield groove faces toward the same direction. Compared with a current differential connector, the differential connector of the present invention has the advantages that a plug-in end of the differential pair of the differential connector of the present invention is provided in the shield groove so as to be isolated from a plug-in end of an adjacent differential pair of the same differential module, thereby completely eliminating electromagnetic interference between differential pairs of adjacent differential modules.

A shield groove is provided on an end shield corresponding to a differential pair of a differential module of another differential connector of the present invention, openings of shield grooves of the end shields corresponding to the differential pairs of the same differential module face toward the same direction, and a plug-in end of the differential pair is provided in the shield groove so as to be isolated from a plug-in end of an adjacent differential pair of the same differential module. The end shields corresponding to the differential pairs of the same differential module constitute an end shield group. When there are two end shield groups, openings of shield grooves of the two end shield groups face toward opposite directions, thereby eliminating interference between plug-in ends of differential pairs of two adjacent differential modules. When there are more than two end shield groups, openings of shield grooves of only one pair of end shield groups in all pairs of adjacent end shield groups face toward opposite directions, and openings of shield grooves of the remaining pairs of adjacent end shield groups face toward the same direction, thereby also ensuring that electromagnetic interference cannot be caused between plug-in ends of differential pairs of two adjacent differential modules. Compared with a current differential connector, the differential connector of the present invention completely eliminates electromagnetic interference between differential pairs of adjacent differential modules, and solves the problem of electromagnetic interference existing between differential pairs of adjacent differential modules of the current differential connector.

Further, the end shield includes an insulator layer and a shield layer laid on the insulator layer, the shield layer is a metal plate, connection ribs are provided between metal plates of adjacent end shields, the end shield is electrically connected to the ground contact or the trace shield through the connection rib, and the connection rib not only further facilitates processing of the metal plate, but also is used for electrical connection with the ground contact or the trace shield to facilitate grounding of the end shield.

Further, an end shield mounting hole is provided on the housing, a hole wall of the end shield mounting hole includes a first mounting hole wall section provided at a notch of a shield groove, the plugging hole is formed by the end shield and the first mounting hole wall section, and the insulator layer is provided between the plugging hole and the shield layer, thereby facilitating processing of the plugging hole, and also facilitating mounting of the end shield.

Further, an integrated module for integrating end shields is provided on the housing, a shield mounting structure adapted to the end shield is provided on the integrated module, the integrated module is of a sleeve structure, the shield mounting structure is provided in the integrated module, corresponding partial shield mounting structures are provided on adjacent side walls of the adjacent integrated modules, and the corresponding partial shield mounting structures constitute the shield mounting structure. The integrated module facilitates mounting of the end shield, and moreover, since the corresponding partial shield mounting structures constitute the shield mounting structure, the end shield may be provided between adjacent integrated modules, thereby reducing the mounting number of integrated modules, and improving the assembly efficiency.

DESCRIPTION OF THE EMBODIMENTS

Figure 1:
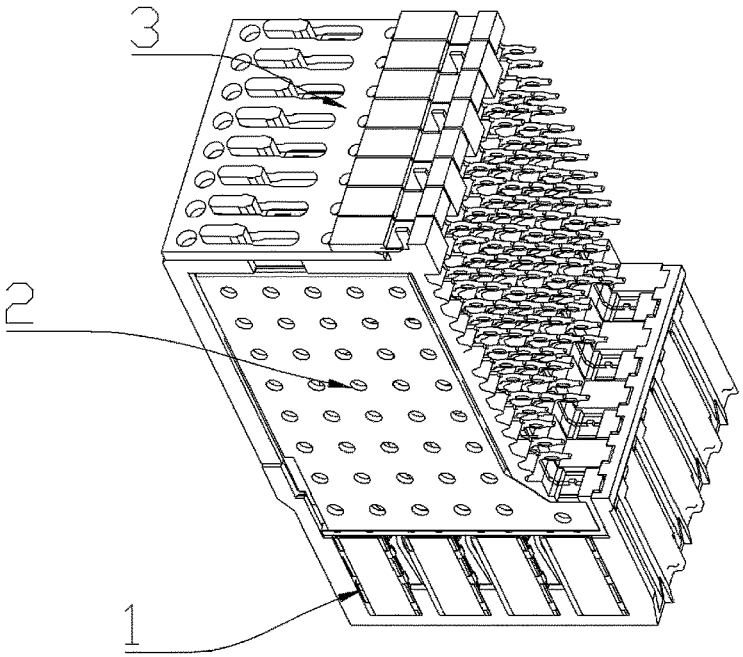
FIG. 1 is schematic structure diagram of a specific embodiment 1 for a differential connector of the present invention.
Figure 2:
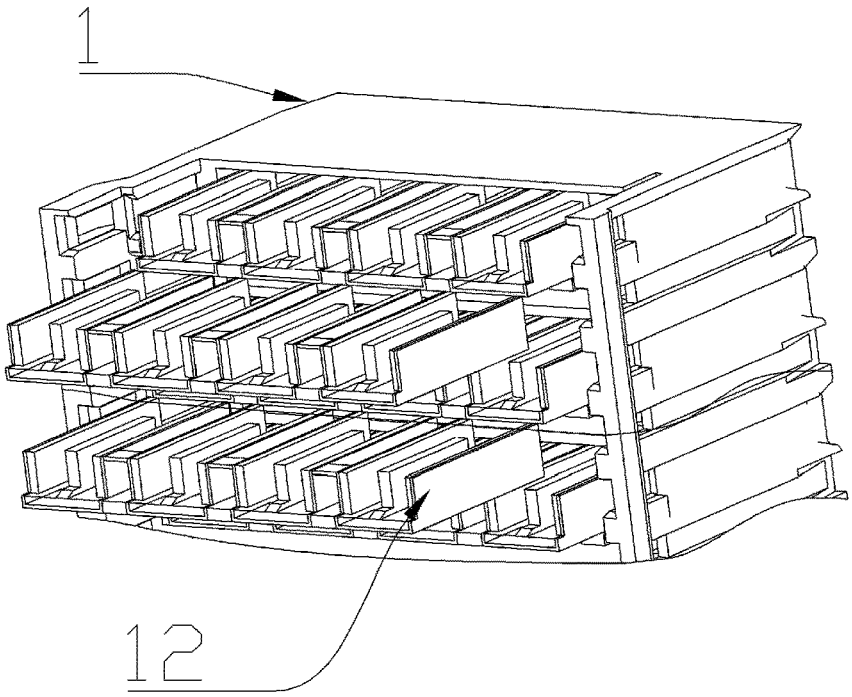
FIG. 2 is a schematic assembly diagram of a partial end shield and a housing component in a specific embodiment 1 for a differential connector of the present invention.
Figure 3:
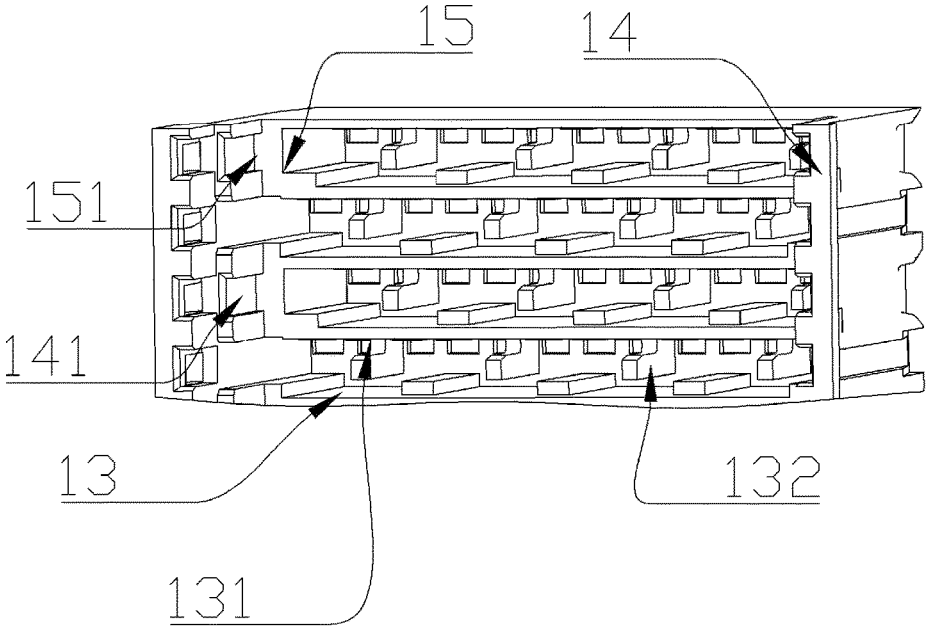
FIG. 3 is a local schematic structure diagram of a housing component in a specific embodiment 1 for a differential connector of the present invention.
Figure 4:
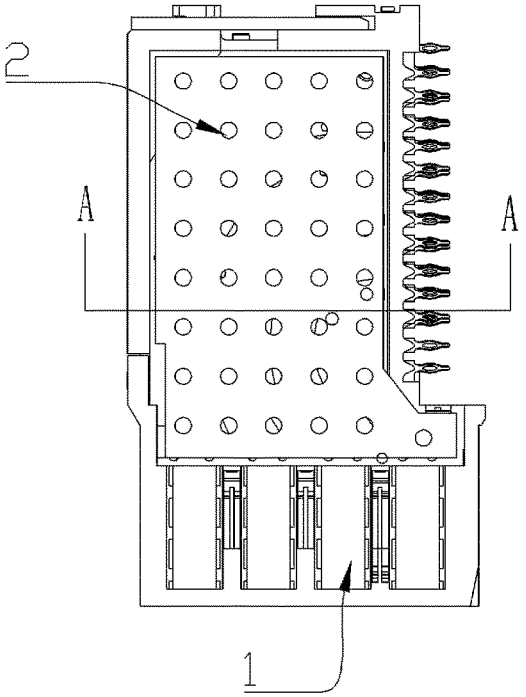
FIG. 4 is a schematic structure diagram of a specific embodiment 1 for a differential connector of the present invention.
Figure 5:
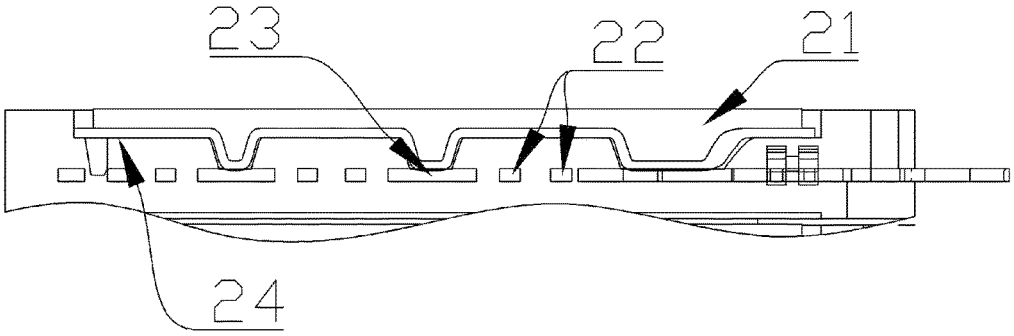
FIG. 5 is a partial sectional view along A-A in FIG. 4.
Figure 6:
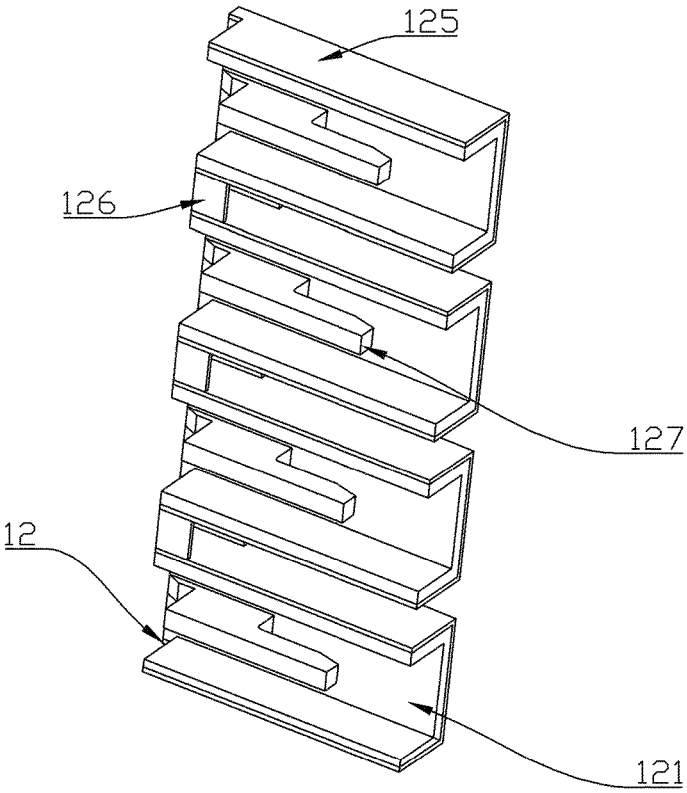
FIG. 6 is schematic structure diagram of an end shield in a specific embodiment 1 for a differential connector of the present invention.

The implementation manner of the present invention is further described below with reference to the accompanying drawings.

In a specific embodiment 1 for a differential connector of the present invention, an end of an existing differential connector is shielded by only one shield sheet, so that the shielding effect is bad. Under the limitation of the size of a housing component, a fully shielded cylindrical end shield sheet cannot be applied to an original differential module, so if the cylindrical end shield is adopted, it is necessary to change the structure of the differential module. For the purpose of reducing electromagnetic interference between differential pairs corresponding to adjacent differential modules as much as possible, the present invention designs a differential connector as follows.

As shown in FIG. 1 to FIG. 8, the differential connector includes a housing component 1, differential modules 2 and a fixing sheet 3 for fixing the differential modules. There are eight differential modules in the present embodiment.

Each differential module 2 includes an insulator 21, differential pairs 22 and ground contacts 23, trace shields being provided on two sides of the insulator 21 respectively. The housing component 1 includes a housing 14, a plugging hole 11 corresponding to the differential pair 22 and a ground contact receptacle 16 corresponding to the ground contact 23 are provided on the housing 14, and the insulator 21 is used for combining the differential pair 22 and the ground contact 23 together. In the present embodiment, a shield plate 24 is adopted as the trace shield, the shield plate 24 being fixed to the insulator. An end shield 12 corresponding to a plug-in end of the differential pair 22 is provided on the housing 14.

The end shield 12 is provided with a shield groove 121 extending along a plugging direction of the plug-in end of the differential pair. In the present embodiment, the shield groove is a U-shaped shield groove. The plug-in end of the differential pair is provided in the shield groove 121. Openings of the shield grooves 121 of the end shields 12 corresponding to the differential pairs 22 of the same differential module face toward the same direction. The plug-in end of the differential pair is provided in the shield groove 121 so as to be isolated from a plug-in end of an adjacent differential pair.

A bottom wall, correspondingly disposed with a notch of the shield groove 121 on the end shield 12, constitutes an adjacent-module differential pair shield portion 122 between the differential pairs corresponding to two adjacent differential modules. Two side walls of the end shield, adjacent to the notch of the shield groove, constitute a same-module differential pair shield portion 123 provided between adjacent differential pairs of the same differential module.

In the present embodiment, the end shields corresponding to the differential pairs of the same differential module constitute an end shield group. In the present embodiment, there are eight differential modules, there are eight corresponding end shield groups, and each end shield group is disposed along a hierarchical direction of the differential module, wherein in the hierarchical direction of the differential module, the four front end shield groups face forward, and the four rear end shield groups face backward.

In other embodiments, the two front end shield groups face forward in the hierarchical direction of the differential module, and the six rear end shield groups face backward. Of course, the arrangement manner is not limited to this, but the following conditions should be satisfied: openings of shield grooves of only one pair of end shield groups in all pairs of adjacent end shield groups face toward opposite directions, and openings of shield grooves of the remaining pairs of adjacent end shield groups face toward the same direction. When the above conditions are satisfied, the number of the end shield groups may be two or more (excluding eight), and when there are two end shield groups, shield notches of the two end shield groups face toward opposite directions.

The end shield 12 is electrically connected to the shield plate 24. In other embodiments, the end shield may also be electrically connected to the ground contact. An end shield mounting hole 13 for mounting the end shield 12 is provided on the housing 14. The end shield 12 includes an insulator layer 124 and a metal plate 125 laid on the insulator layer. The metal plate 125 constitutes a shield layer laid on the insulator layer. In the present embodiment, in order to ensure insulated isolation between the shield layer and the differential pair, the shield layer is laid on an outer surface of the insulator layer, and the insulator layer is provided between the plugging hole and the shield layer to ensure good insulated isolation between the shield layer and the differential pair. The metal plates of the adjacent end shields are connected through connection ribs 126. In the present embodiment, the end shield 12 includes a portion located inside the end shield mounting hole and a portion located outside the end shield mounting hole, and the two portions are disposed along the plugging direction of the differential pair. The connection rib is connected to the portions, located outside the end shield mounting holes, on the adjacent end shields. An assembly relationship between the end shield and the housing component may be simplified as much as possible, and meanwhile, the end shield is electrically connected to the trace shield through the connection rib, thereby facilitating electrical connection between the end shield and the trace shield.

In the present embodiment, in order to facilitate mounting of the end shield and forming of a modular structure, an integrated module 15 configured for integrating the end shields corresponding to the same differential module is provided on the housing 14, the integrated module 15 being of a sleeve structure. A guide key 151 is provided on the outer side of the integrated module, and a guide groove 141 matching the guide key is provided on the housing, thereby facilitating mounting of the integrated module.

In order to facilitate mounting of the end shield and reduce the size of the end shield as much as possible, in the present embodiment, a hole wall of the end shield mounting hole 13 includes a first mounting hole wall section 131 provided at the notch of the shield groove, and the plugging hole 11 is formed by a groove wall of the shield groove and the first mounting hole wall section 131. The end shield mounting hole 13 of the end shield 12 is provided on the integrated module 15. In the present embodiment, the plugging hole and the end shield mounting hole share the first mounting hole wall section.

An insulated partition plate is provided between two plugging holes corresponding to the differential pair 22. In the present embodiment, the insulated partition plate is formed by combining an L-shaped insulated plate 132 provided on the first mounting hole wall section and located in the end shield mounting hole and an inverted L-shaped insulated plate 127 provided on the insulator layer and being in buckled connection with the L-shaped insulated plate, and a positioning structure for positioning the end shield is also provided in the end shield mounting hole. In the present embodiment, the positioning structure includes a positioning boss in positioning fit with the end shield.

The integrated module 15 is detachably and fixedly connected to the housing 14. The end shield mounting hole is provided in the integrated module. In the present embodiment, in order to further reduce the size of the housing component and facilitate mounting, the end shield mounting holes corresponding to the end shields of the same differential module run through each other along the arrangement direction of the differential pairs to constitute a mounting cavity provided in the integrated module. In the present embodiment, each end shield is mounted in the mounting cavity. In other embodiments, the integrated module may also be of a plate-like structure, the end shield mounting holes are provided on the integrated module independently, and at this time, adjacent side faces of adjacent integrated modules form end shield mounting holes independent of each other. In the present embodiment, the adjacent end shields are provided at intervals, and form a ground contact receptacle 16 with the integrated module.

The first mounting hole wall section is provided in the integrated module, and the L-shaped insulated plate 132 provided in the integrated module and the positioning structure for positioning the end shield constitute a shield mounting structure provided in the integrated module and used for mounting the end shield. Corresponding partial shield mounting structures are provided on adjacent side walls of the adjacent integrated modules, and the corresponding partial shield mounting structures constitute the shield mounting structure. In the present embodiment, the positioning structure is provided on the side wall of one of the integrated modules, and the L-shaped insulated plate is provided on the adjacent side wall of the adjacent integrated module. The positioning structure and the L-shaped insulated plate on the side walls of an integrated module constitute a partial shield mounting structure, corresponding to two adjacent integrated modules, on the present integrated module. Only one side wall of the side walls of an edge integrated module is provided with the partial shield mounting structure corresponding to the adjacent integrated module. In other embodiments, the insulated partition plate may be provided on the end shield, and at this time, the shield mounting structure may be multiple positioning tables in positioning fit with the end shields.

Figure 7:
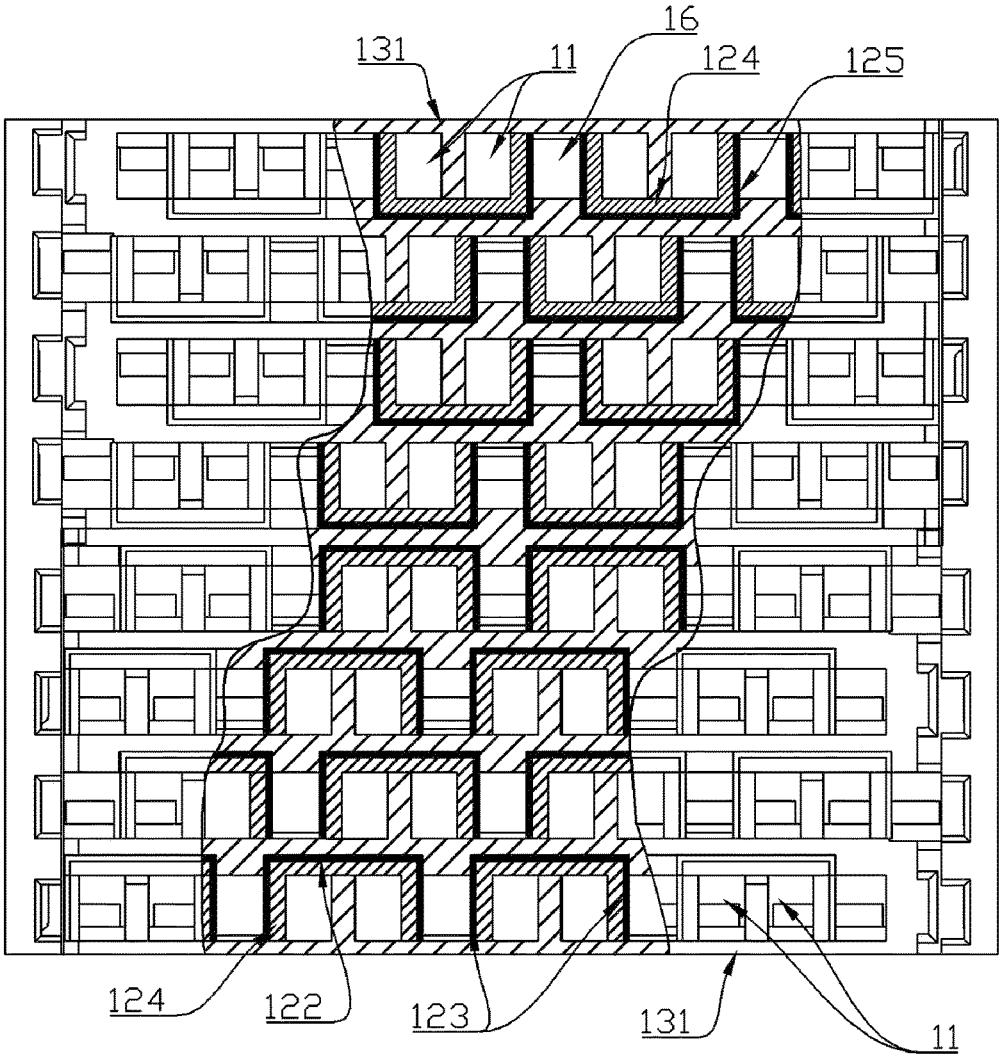
FIG. 7 is a partial sectional view of an assembly of an end shield and a housing component in a specific embodiment 1 for a differential connector of the present invention.
Figure 8:
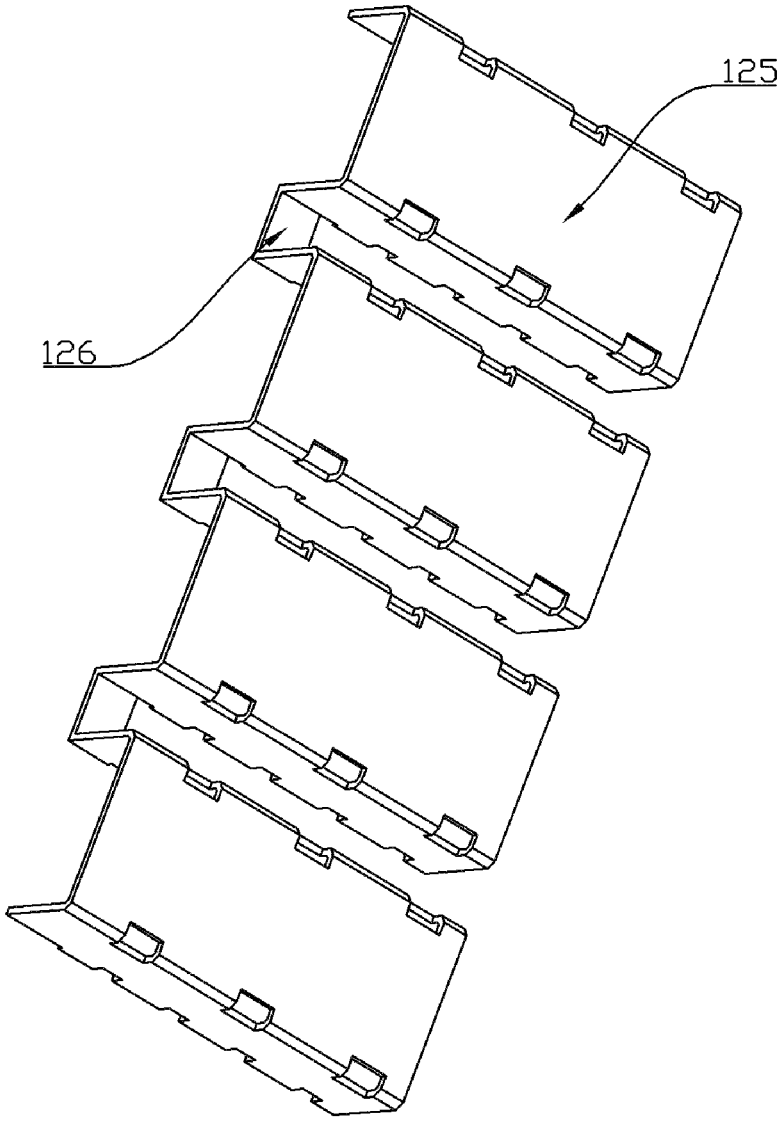
FIG. 8 is a schematic structure diagram of a shield plate in FIG. 6.

The differential pair of the present invention is provided in the U-shaped shield groove. As shown in FIG. 7, for the adjacent end shield groups where the openings of the shield grooves face toward the same direction, since an electromagnetic interference path of differential pairs of adjacent differential modules is closed, the plug-in ends of the differential pairs of the adjacent differential modules cannot cause electromagnetic interference, and electromagnetic interference between diagonally adjacent differential pairs is also eliminated, thereby greatly improving the quality of signal transmission. In the same way, for the adjacent end shield groups where the openings of the shield grooves face toward opposite directions, the plug-in ends of the differential pairs of the adjacent differential modules cannot also cause electromagnetic interference.

The end shield of the present invention adopts a method of laying a shield layer on an insulator layer, which is not only suitable for laying a metal plate on an insulator layer, but also can lay a plating layer or other materials capable of absorbing or reflecting electromagnetic waves on an insulator layer. The shield layer needs to be electrically connected to the trace shield or the ground contact only when it is a conductive medium.

Figure 9:
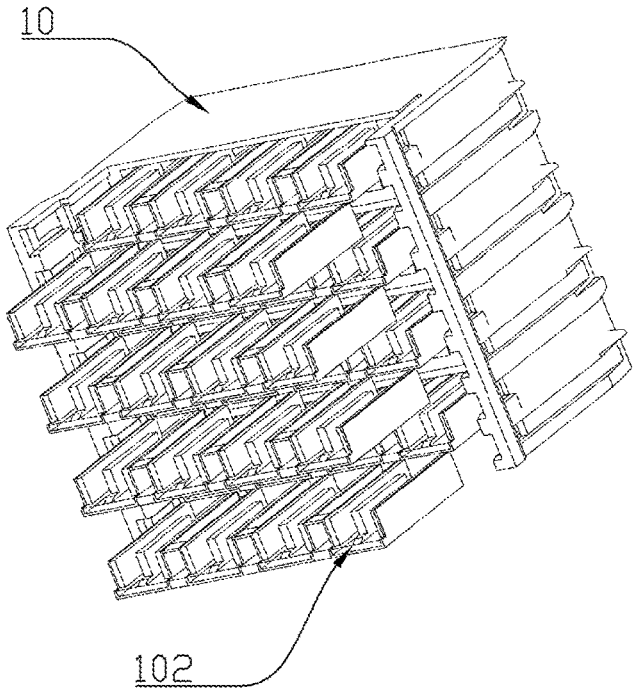
FIG. 9 is a schematic assembly diagram of a end shield and a housing component in a specific embodiment 2 for a differential connector of the present invention.
Figure 10:
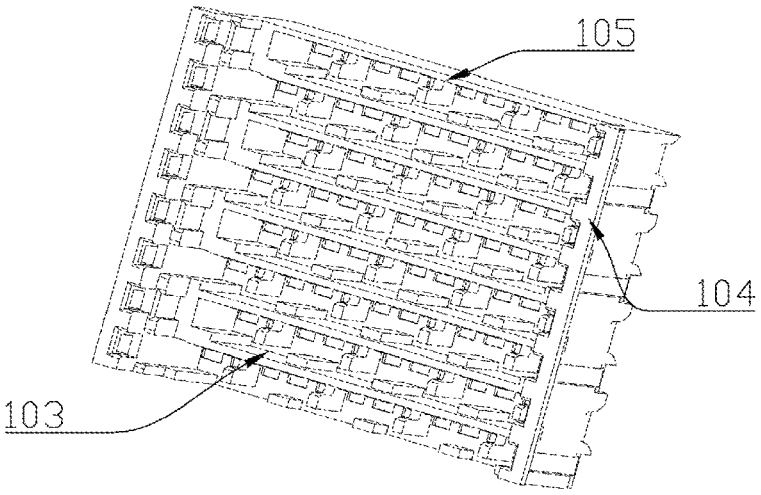
FIG. 10 is a schematic structure diagram of a housing component in a specific embodiment 2 for a differential connector of the present invention.
Figure 11:
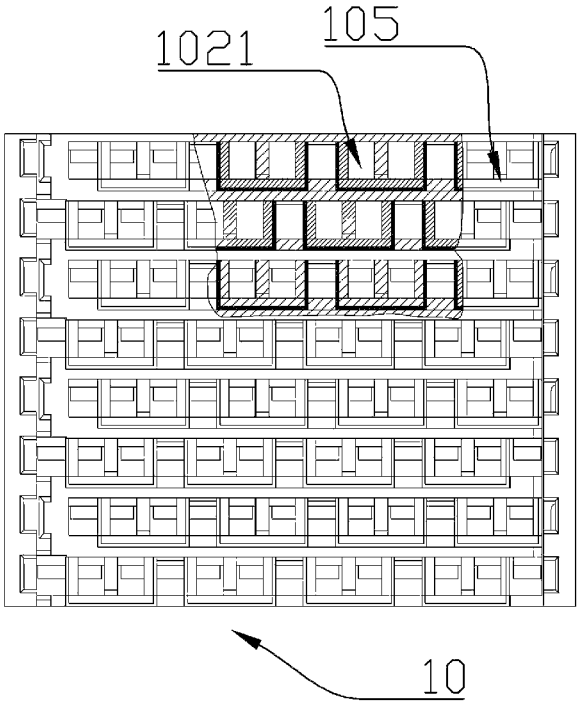
FIG. 11 is a partial sectional view of an assembly of an end shield and a housing component in a specific embodiment 2 for a differential connector of the present invention.

In a specific embodiment 2 for a differential connector of the present invention, the difference between the differential connector in the present embodiment and the differential connector described in the specific embodiment 1 for the foregoing differential connector is only that in the present embodiment as shown in FIG. 9, openings of shield grooves 1021 of end shields 102 corresponding to differential pairs of each differential module face toward the same direction, the openings of each shield groove 1021 facing toward the same arrangement direction of the differential modules. Correspondingly, as shown in FIG. 10 and FIG. 11, the structures of the housing 104, the integrated module 105 and the end shield mounting hole 103 of the housing component 10 are all adaptively changed. The differential pair of the present invention is provided in a U-shaped shield groove 1021, and openings of the shield grooves 1021 face toward the same direction. As shown in FIG. 11, since an electromagnetic interference path of differential pairs of adjacent differential modules is closed, the plug-in ends of the differential pairs of the adjacent differential modules cannot cause electromagnetic interference, and electromagnetic interference between diagonally adjacent differential pairs is also eliminated, thereby greatly improving the quality of signal transmission. The other partial structures are the same as those described in the specific embodiment 1 for the foregoing differential connector, and the descriptions thereof are omitted herein.

In specific embodiments for a differential connector housing component of the present invention, the differential connector housing component has the same structure as the housing component described in the specific embodiment 1 or 2 for the foregoing differential connector, and the descriptions thereof are omitted herein.

In other embodiments for a differential connector of the present invention and a differential connector housing component used for the differential connector, the foregoing end shield may only include a shield layer, at this time, an end shield mounting hole corresponding to the end shield is provided on the housing, and during assembly, the end shield is directly inserted into the end shield mounting hole. The foregoing integrated module and the housing body may be of an integrated structure, the integrated module being embedded in the housing. The foregoing ground contact may not extend into the ground contact receptacle of the housing component, and plug-in ends of differential pairs of the same differential module are shielded by only the end shield. The foregoing connection rib may not be provided, and at this time, each metal plate is electrically connected to the ground contact or the shield plate. The adjacent side faces of the adjacent integrated modules may not be provided with the shield mounting structure, and at this time, the end shield mounting holes are provided in the integrated module respectively. The ground contact receptacle corresponding to the foregoing ground contact may not be provided, according to the mounting position of the ground contact, under the premise of ensuring that the ground contact is insulated from the differential pair, the ground contact and the differential pair contact may be provided in the same receptacle.

What is claimed is:

1. A differential connector, comprising a housing component and two or more differential modules, each differential module comprising an insulator, differential pairs and ground contacts, the housing component comprising a housing, a plugging hole corresponding to a plug-in end of the differential pair being provided on the housing, wherein an end shield corresponding to the plug-in end of the differential pair is provided on the housing; the end shield is provided with a shield groove extending along a plugging direction of the plug-in end of the differential pair;

opening of each shield groove faces toward the same direction; and the plug-in end of the differential pair is provided in the shield groove so as to be isolated from a plug-in end of an adjacent differential pair of the same differential module;

alternatively, openings of shield grooves of the end shields corresponding to the differential pairs of the same differential module face toward the same direction; the plug-in end of the differential pair is provided in the shield groove and is isolated from a plug-in end of an adjacent differential pair of the same differential module; the end shields corresponding to the differential pairs of the same differential module constitute an end shield group; when there are two end shield groups, openings of shield grooves of the two end shield groups face toward opposite directions; and when there are more than two end shield groups, openings of shield grooves of only one pair of end shield groups in all pairs of adjacent end shield groups face toward opposite directions, and openings of shield grooves of the remaining pairs of adjacent end shield groups face toward the same direction.

2. The differential connector according to claim 1, wherein the end shield comprises an insulator layer and a shield layer provided on the insulator layer; the shield layer is a conductive shield layer; a trace shield is provided on at least one side of the insulator, the trace shield being provided between any two of the differential modules; and the shield layer is electrically connected to the ground contact or the trace shield.

3. The differential connector according to claim 2, wherein the shield layer is a metal plate; connection ribs are provided between metal plates of adjacent end shields; and the shield layer is electrically connected to the ground contact or the trace shield through the connection ribs.

4. The differential connector according to claim 2, wherein an end shield mounting hole is provided on the housing; a shield mounting structure is provided in the end shield mounting hole; a hole wall of the end shield mounting hole comprises a first mounting hole wall section provided at a notch of the shield groove; the plugging hole is formed by the end shield and the first mounting hole wall section; and the insulator layer is provided between the plugging hole and the shield layer.

5. The differential connector according to claim 1, wherein an integrated module configured for integrating the end shields is provided on the housing; a shield mounting structure adapted to the end shield is provided on the integrated module; the integrated module is of a sleeve structure; the shield mounting structure is provided in the integrated module; corresponding partial shield mounting structures are provided on adjacent side walls of the adjacent integrated modules; and the corresponding partial shield mounting structures constitute the shield mounting structure.

6. The differential connector according to claim 5, wherein an insulated partition plate is provided between two plugging holes corresponding to the differential pairs; the shield mounting structure comprises an L-shaped insulated plate; an inverted L-shaped insulated plate in buckled connection with the L-shaped insulated plate is provided on the insulator layer; and the insulated partition plate consists of the L-shaped insulated plate and the inverted L-shaped insulated plate.

7. The differential connector according to claim 3, wherein an end shield mounting hole is provided on the housing; a shield mounting structure is provided in the end shield mounting hole; a hole wall of the end shield mounting hole comprises a first mounting hole wall section provided at a notch of the shield groove; the plugging hole is formed by the end shield and the first mounting hole wall section; and the insulator layer is provided between the plugging hole and the shield layer.

8. The differential connector according to claim 2, wherein an integrated module configured for integrating the end shields is provided on the housing; a shield mounting structure adapted to the end shield is provided on the integrated module; the integrated module is of a sleeve structure; the shield mounting structure is provided in the integrated module; corresponding partial shield mounting structures are provided on adjacent side walls of the adjacent integrated modules; and the corresponding partial shield mounting structures constitute the shield mounting structure.

9. The differential connector according to claim 3, wherein an integrated module configured for integrating the end shields is provided on the housing; a shield mounting structure adapted to the end shield is provided on the integrated module; the integrated module is of a sleeve structure; the shield mounting structure is provided in the integrated module; corresponding partial shield mounting structures are provided on adjacent side walls of the adjacent integrated modules; and the corresponding partial shield mounting structures constitute the shield mounting structure.

10. The differential connector according to claim 8, wherein an insulated partition plate is provided between two plugging holes corresponding to the differential pairs; the shield mounting structure comprises an L-shaped insulated plate; an inverted L-shaped insulated plate in buckled connection with the L-shaped insulated plate is provided on the insulator layer; and the insulated partition plate consists of the L-shaped insulated plate and the inverted L-shaped insulated plate.

11. The differential connector according to claim 9, wherein an insulated partition plate is provided between two plugging holes corresponding to the differential pairs; the shield mounting structure comprises an L-shaped insulated plate; an inverted L-shaped insulated plate in buckled connection with the L-shaped insulated plate is provided on the insulator layer; and the insulated partition plate consists of the L-shaped insulated plate and the inverted L-shaped insulated plate.

12. A differential connector housing component, comprising a housing, a plugging hole configured for corresponding to a plug-in end of a differential pair being provided on the housing, wherein an end shield corresponding to the plug-in end of the differential pair is provided on the housing; the end shield is provided with a shield groove extending along a plugging direction of the plug-in end of the differential pair and containing the plug-in end of the differential pair such that the plug-in end of the differential pair is isolated from a plug-in end of an adjacent differential pair of the same differential module;

opening of each shield groove faces toward the same direction;

alternatively, openings of shield grooves of the end shields corresponding to the differential pairs of the same differential module face toward the same direction; the end shields corresponding to the differential pairs of the same differential module constitute an end shield group; when there are two end shield groups, openings of shield grooves of the two end shield groups face toward opposite directions; and when there are more than two end shield groups, openings of shield grooves of only one pair of end shield groups in all pairs of adjacent end shield groups face toward opposite directions, and openings of shield grooves of the remaining pairs of adjacent end shield groups face toward the same direction.

13. The differential connector housing component according to claim 12, wherein the end shield comprises an insulator layer and a shield layer provided on the insulator layer; the shield layer is a conductive shield layer; and the shield layer is electrically connected to a ground contact or a trace shield.

14. The differential connector housing component according to claim 13, wherein the shield layer is a metal plate; connection ribs are provided between metal plates of adjacent end shields; and the shield layer is electrically connected to the ground contact or the trace shield through the connection ribs.

15. The differential connector housing component according to claim 13, wherein an end shield mounting hole is provided on the housing; a hole wall of the end shield mounting hole comprises a first mounting hole wall section provided at a notch of the shield groove; the plugging hole is formed by the end shield the shield groove and the first mounting hole wall section; and the insulator layer is provided between the plugging hole and the shield layer.

16. The differential connector housing component according to claim 12, wherein an integrated module configured for integrating end shields is provided on the housing; a shield mounting structure adapted to the end shield is provided on the integrated module; the integrated module is of a sleeve structure; the shield mounting structure is provided in the integrated module; corresponding partial shield mounting structures are provided on adjacent side walls of the adjacent integrated modules; and the corresponding partial shield mounting structures constitute the shield mounting structure.

17. The differential connector housing component according to claim 16, wherein an insulated partition plate is provided between two plugging holes corresponding to differential pairs; the shield mounting structure comprises an L-shaped insulated plate; an inverted L-shaped insulated plate in buckled connection with the L-shaped insulated plate is provided on the insulator layer; and the insulated partition plate consists of the L-shaped insulated plate and the inverted L-shaped insulated plate.

18. The differential connector housing component according to claim 14, wherein an end shield mounting hole is provided on the housing; a hole wall of the end shield mounting hole comprises a first mounting hole wall section provided at a notch of the end shield; the plugging hole is formed by the shield groove and the first mounting hole wall section; and the insulator layer is provided between the plugging hole and the shield layer.

19. The differential connector housing component according to claim 13, wherein an integrated module configured for integrating end shields is provided on the housing; a shield mounting structure adapted to the end shield is provided on the integrated module; the integrated module is of a sleeve structure; the shield mounting structure is provided in the integrated module; corresponding partial shield mounting structures are provided on adjacent side walls of the adjacent integrated modules; and the corresponding partial shield mounting structures constitute the shield mounting structure.

20. The differential connector housing component according to claim 14, wherein an integrated module configured for integrating end shields is provided on the housing; a shield mounting structure adapted to the end shield is provided on the integrated module; the integrated module is of a sleeve structure; the shield mounting structure is provided in the integrated module; corresponding partial shield mounting structures are provided on adjacent side walls of the adjacent integrated modules; and the corresponding partial shield mounting structures constitute the shield mounting structure.

* * * * *